US005663788A

United States Patent [19]

Sanpe

[11] Patent Number: 5,663,788

[45] Date of Patent: Sep. 2, 1997

[54] EFFICIENTLY REMOVABLE DEVELOPING TONER IN AN ELECTROSTATIC IMAGE FORMING APPARATUS

[75] Inventor: Atsushi Sanpe, Yokohama, Japan

[73] Assignee: Ricoh Company, Ltd., Tokyo, Japan

[21] Appl. No.: 42,018

[22] Filed: Apr. 2, 1993

[30] Foreign Application Priority Data

Apr. 2, 1992 [JP] Japan ..... 4-080919

[51] Int. Cl.[6] ..... G03G 21/00; G03G 15/01; G03G 15/14

[52] U.S. Cl. ..... 399/353; 399/315; 399/223

[58] Field of Search ..... 355/296, 297, 355/298, 299, 300–303, 219, 305, 326 R; 118/652; 430/109, 111, 114, 107, 122, 137; 15/256.5, 256.51

[56] References Cited

U.S. PATENT DOCUMENTS

| | | | |
|---|---|---|---|
| 3,985,665 | 10/1976 | Sakaguchi et al. | 430/109 |
| 3,989,372 | 11/1976 | Davidge et al. | 355/298 |
| 4,021,113 | 5/1977 | Zindikus et al. | 355/297 |
| 4,252,433 | 2/1981 | Sullivan | 355/298 |
| 4,494,863 | 1/1985 | Laing | 355/302 |
| 4,506,975 | 3/1985 | Shukuri et al. | 118/652 X |
| 4,564,282 | 1/1986 | Shenoy | 355/296 X |
| 4,812,377 | 3/1989 | Wilson et al. | 430/109 |
| 4,819,026 | 4/1989 | Lange et al. | 118/652 X |
| 4,855,207 | 8/1989 | Tsubuko et al. | 430/109 |
| 4,870,466 | 9/1989 | Iida | 355/297 |
| 4,885,350 | 12/1989 | Yamashita et al. | 526/201 |
| 4,965,131 | 10/1990 | Nair et al. | 430/137 X |
| 4,969,015 | 11/1990 | Sanpe | 355/301 X |
| 4,971,302 | 11/1990 | Morii et al. | 270/53 |
| 5,072,920 | 12/1991 | Kubota et al. | 219/121.72 |
| 5,077,158 | 12/1991 | Nakano | 430/109 X |
| 5,078,085 | 1/1992 | Fuji et al. | 430/122 X |
| 5,080,342 | 1/1992 | Mori et al. | 271/221 X |
| 5,099,292 | 3/1992 | Hirose | 355/308 X |
| 5,121,911 | 6/1992 | Yamazaki et al. | 271/213 X |
| 5,148,227 | 9/1992 | Senba et al. | 355/296 |
| 5,173,388 | 12/1992 | Uezono et al. | 430/122 |
| 5,182,601 | 1/1993 | Hodoshima et al. | 355/305 X |
| 5,212,038 | 5/1993 | Watanabe et al. | 430/122 |
| 5,212,530 | 5/1993 | Harada et al. | 355/301 |
| 5,233,398 | 8/1993 | Nimura et al. | 355/301 |
| 5,233,399 | 8/1993 | Shiino et al. | 355/302 |
| 5,260,754 | 11/1993 | Yano et al. | 355/296 |
| 5,296,328 | 3/1994 | Fuji et al. | 430/122 |
| 5,321,091 | 6/1994 | Hiyousu et al. | 430/107 X |
| 5,362,200 | 11/1994 | Ushirogata | 271/293 X |

FOREIGN PATENT DOCUMENTS

| | | |
|---|---|---|
| 59-7986 | 1/1984 | Japan . |
| 4-243267 | 8/1992 | Japan . |

*Primary Examiner*—Shuk Yin Lee

*Attorney, Agent, or Firm*—Oblon, Spivak, McClelland, Maier & Neustadt, P.C.

[57] ABSTRACT

An electrostatic image forming apparatus has high cleaning efficiency using the electrostatic fur brush method. A photosensitive body having a photoconductive characteristic is charged uniformly. An electrostatic latent image is formed on the surface of the charged photosensitive body by radiating light rays on the area to be developed. The latent image is developed by the dry-type developing method by use of toner charged with same polarity as that of the photosensitive body's surface. The obtained visible image is transferred electrostatically onto the transfer paper. A non-electrically-insulative fur brush 16 removes the remaining toner 20 from the surface of the photosensitive body 14 and an electric potential gradient generator 17 generates an electric potential gradient through the fur brush which transfers the remaining toner 20 to the fur brush 16 from the surface of the photosensitive body 14. The toner to be employed has a substantially uniform particle diameter.

6 Claims, 5 Drawing Sheets

EFFICIENTLY REMOVABLE DEVELOPING TONER IN AN ELECTROSTATIC IMAGE FORMING APPARATUS

BACKGROUND OF THE INVENTION

1. Field of the Invention

The present invention relates to an electrostatic image forming apparatus, usable in a printer, facsimile or digital copying machine.

2. Description of the Related Art

In an optical printer or a digital copying machine, after uniformly charging a photosensitive body having a photoconductive characteristic, the exposure of the portion to be visible is done by radiating light rays, and thereby an electrostatic latent image is formed thereon.

The electrostatic latent image is developed by toner charged with a polarity which is the same as that of the photosensitive body. A visible image obtained in such a manner is electrostatically transferred onto transfer paper.

The toner for forming the visible image on the photosensitive body is not always entirely transferred onto the transfer paper. Even after transferring the visible image onto the recording paper, a considerable amount of toner remains on the photoconductive body. In such a situation, it may be necessary to perform cleaning of the toner remaining on the photosensitive body such that the remaining toner does not have any effect on the subsequent image forming process.

An electrostatic fur brush method has ben well known as a cleaning method. In this method, cleaning is done in such a manner that toner is electrostatically captured by the fur brush.

At the time of electrostatic transferring, the toner creating the visible image formed on the photosensitive body is exposed to a corona discharge of inverse polarity to that of charge at the time of developing.

Until now, there remained a considerable amount of toner inversely charged to the polarity of the remaining toner.

The amount of charge in the respective remaining toner is not constant. Generally, the distribution of the charge amount forms a peak on a distribution graph.

Until now, there remained a problem that it was difficult to increase the cleaning efficiency by using the electrostatic fur brush method, in view of the distribution of the charge amount in the remaining toner.

SUMMARY OF THE INVENTION

It is an object of the present invention to solve the above problem.

It is a further object of the present invention to effectively raise the cleaning efficiency of the electrostatic fur brush method.

It is yet another object of the present invention to provide a novel electrostatic image forming apparatus capable of performing electronic image forming.

In the electrostatic image forming apparatus according to the present invention, the photosensitive body having a photoconductive characteristic is charged uniformly, an electrostatic latent image is formed on the photosensitive body by exposing the area to be developed to light rays, to develop the electrostatic latent image by use of a dry-type development method employing a toner charged with the same polarity as that of the charge on the photosensitive body, and the obtained visible image is transferred onto transfer paper. Namely, the toner is charged with a same polarity as that of the electric potential on the photosensitive body for forming the electrostatic latent image, and the toner charged in such manner is used for developing the image.

The electrostatic image forming apparatus includes a cleaning charger, a fur brush and an electric potential gradient generating means.

The discharging voltage is created by superposing an AC (Alternate Current) voltage on a DC voltage of the above-mentioned polarity, and it is applied to the precleaning charger in order to recharge the toner remaining body after transferring the visible image.

The fur brush is made of a non-electrically-insulative substance (of an electric resistance not larger than about $10^5$–$10^{10}$ Ω.cm), and it is frictionally brought into contact with the surface of the photosensitive body and removes the remaining toner recharged by the above-mentioned precleaning charger form the surface of the photosensitive body.

The electric potential gradient generating means generates an electric potential gradient through the fur brush in order to transfer the recharged toner from the photosensitive body to the fur brush.

The electrostatic image forming apparatus is characterized in that the employed toner has a relative dielectric constant in the range of 2.5–3.

The electrostatic image forming apparatus comprises the fur brush and the electric potential gradient generating means, and toner having a substantially uniform diameter is employed in the apparatus. Moreover, the discharging voltage created by superposing the AC voltage onto the DC voltage of the above-mentioned predetermined polarity is applied to the precleaning charger with a predetermined polarity prior to the removal of the remaining toner by use of the fur brush after transferring the visible image to the recording paper.

And further, the voltage potential between the electric potential gradient generating means and the surface of the photosensitive body can be made 200 V–700 V.

The diameter of the toner employed in the electronic image forming apparatus can be made not larger than 7 μm, and the relative dielectric constant of the toner can have a value in the range of 2.5–3.

In the electronic image forming apparatus, the precleaning charger recharges the toner remaining on the surface of the photosensitive body with a predetermined polarity after transferring the visible image onto the recording paper. However, even though the toner is recharged with such predetermined polarity, the charge amount of the toner does not become uniform. Instead, the distribution of the charge amount is peaked.

Consequently, the toner remaining after recharging contains a mixture of toner having more charge than average and other toner having less charge than average.

In order to transfer the remaining toner to the fur brush, it is necessary for the electric potential gradient formed through the fur brush to overcome the force for fastening the remaining toner onto the surface of the photosensitive body (mainly, the electric mirror image force).

The electric potential difference capable of applying an electric potential gradient necessary for transferring the remaining toner to the fur brush against the above-mentioned force is called the "removing bias".

If the electric potential gradient is made sufficiently large, it may be possible to transfer even the strongly charged remaining toner to the fur brush. However, if the gradient is made excessively large, the electric charge moves toward the toner from the tip end of the fur brush and it inversely charges the remaining toner once again.

Since the fur brush repels the remaining toner inversely charged thereby in such a manner, the toner cannot be removed from the surface of the photosensitive body, or even if is removed therefrom it adheres to the photosensitive body once again.

The electric potential difference capable of applying an electric potential gradient enabling the inverse charging of the remaining toner by use of the fur brush as mentioned above is called "background soiling bias".

It has been discovered that the above-mentioned "removing bias" increases gradually with an increase in the toner's relative dielectric constant, while the above-mentioned "background soiling bias" decreases more rapidly with an increase of the toner's relative dielectric constant.

Furthermore, the wider the distribution of the toner's diameter, the larger the width of the charge distribution in the remaining toner. On the other hand, when the toner's diameter becomes substantially constant, the width of the charge distribution in the remaining toner turns out to be small.

The powder toner conventionally employed for the dry-type development is that produced by the "crushing method", and the distribution of the toner's diameter has a distribution width on the order of 10 μm. On the contrary, the toner produced by the new polymerizing method has a diameter distribution width not larger than 1 to several μm. The diameter of the toner produced in such manner is substantially uniform. The toner having such a substantially uniform diameter has, generally, a charge distribution of narrow width.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
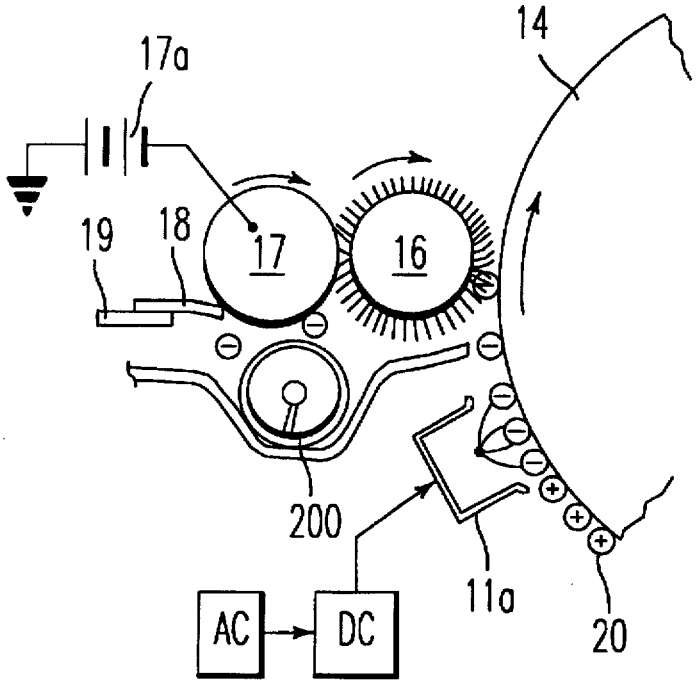
FIG. 1(A) is a schematic view for illustrating an optical printer and its cleaning portion in an embodiment of an electrostatic image forming apparatus to which the photosensitive is applicable.
Figure 1B:
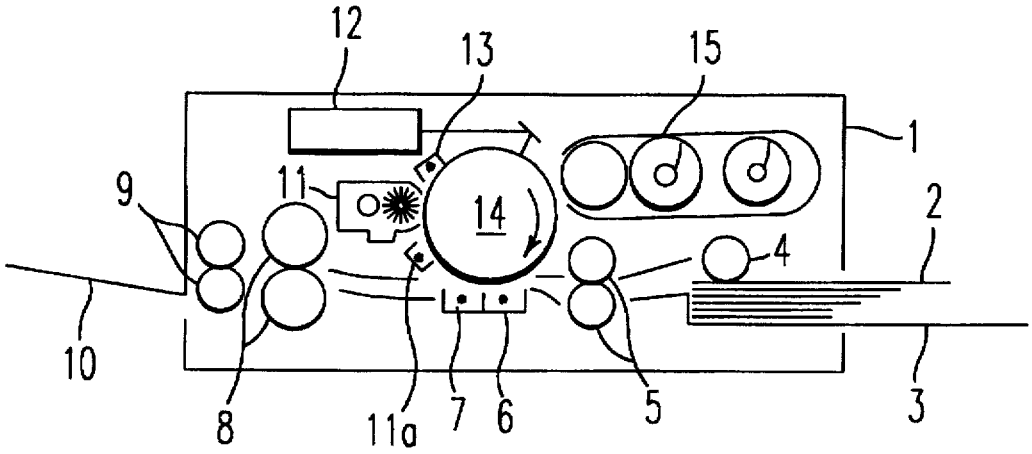
FIG. 1(B) is a side view of the overall construction of the electrostatic image forming apparatus as shown in FIG. 1(A)

FIG. 1(B) shows an optical printer as one example of electrostatic image forming apparatus to which the present invention can be applied. The photosensitive body 14 having a photoconductive characteristic is disposed in the main body 1.

The photosensitive body 14 is formed in the shape of a drum and is rotatably driven clockwise. A precleaning charger (corotron) 11*a*, a cleaning apparatus 11, an optical writing-in apparatus 12, a charger 13 a developing apparatus 15, a pair of resist rollers 5, a transfer charger 6, a separation charger 7, a fixing apparatus 8 and a pair of discharging rollers 9 are arranged around the photosensitive body 14.

The image forming process is performed as described below.

The photosensitive body 14 rotates clockwise with uniform angular velocity and the circumferential surface thereof is uniformly charged by the charger 13. The polarity of charging is determined in accordance with the property of the photosensitive body. In this embodiment, it is negative. The negatively charged surface of the photosensitive body is written in by an optical writing-in apparatus. This writing-in apparatus functions by radiating light rays on the area to be developed. The electrostatic latent image formed by the above writing-in operation is developed by the dry-type method by use of the developing apparatus 15. The toner employed for developing is charged negatively, namely, with the same polarity as that of the photosensitive body charged by the charger 13. Therefore, the toner charged in such manner selectively adheres to the area of the photosensitive body on which the surface electric potential is attained by radiating light rays at the time of writing-in.

The transfer paper 2, onto which the visible image formed on the surface of the photosensitive body 14 in such manner is transferred, is fed out by the paper feeding roller 4 from the cassette 3, and the paper 2 is sent into the transferring portion with suitable timing established by the resist roller 5, and is superposed on the visible image on the photosensitive body 14.

The transfer charger 6 then performs corona discharging with positive polarity (in inverse polarity to that of toner charge) from the rear surface of the transfer paper 2.

In such a manner, the visible developed image is transferred onto the transfer paper 2. Next, the separation charger 7 performs the corona discharging with a discharging voltage created by superposing an AC voltage on a DC voltage of inverse polarity to that of the discharging of the transfer charger 6, and thereby the excessive electric charge on the transfer paper 2 is removed and the transfer paper 2 is separated from the photosensitive body 14.

The transfer paper 2 is sent to the fixing apparatus 8 and the visible image is fixed on the transfer paper 2 in the fixing apparatus. Thereafter, the paper 2 is discharged onto the tray 10 by the discharging rollers 9.

After transferring the visible image on the transfer paper 2, the precleaning charger 11*a* recharges the remaining toner in the predetermined polarity, and the recharged remaining toner is removed from the surface of the photosensitive body 14 by the cleaning apparatus 11.

FIG. 1(A) shows the featured portion for practicing the present invention in the apparatus shown in FIG. 1(B). The cleaning apparatus 11 contains a fur brush 16, a bias roller 17 and a blade 18 in its housing. The fur brush 16 is constructed with an acrylic carbon fiber having an essential volume resistance ratio of $10^5$–$10^{10}$ Ω.cm, planted on a stainless steel roller having an outer diameter of 10 mm. The outer diameter of the fur brush's outer circumferential portion is 20 mm. The circumferential surface of the photosensitive body 14 eats into the brush portion of the fur brush 16 by 0.5–2 mm.

The bias roller 17 is a stainless steel roller having an outer diameter of 12 mm and it eats into the brush portion of the fur brush 16 by 0.5–2 mm. And further, it may be possible to coat the surface of the blade with a conductive resin such as Teflon mixed with carbon or the like, in order to raise the efficiency of removing the toner by the blade 18.

In this embodiment, the bias roller 17 functions as an electric potential gradient generating means.

DC voltage is applied to roller 17 by the DC voltage power source 17*a*. Since the fur brush 16 is not electrically insulative, the electric potential gradient arises between the bias roller 17 and the photoconductive body 14 through the fur brush 16 by the action of the voltage of the bias roller 17 brought into contact with the fur brush 16.

The electric potential gradient functions so as to cause the fur brush 16 to capture the remaining toner 20.

Hereupon, since the image area on the photosensitive body 14 is charged with −500 V—600 V when coming into contact with the fur brush 16, when the DC power source 17*a* applies the voltage of about −300- +200 V to the bias roller 17, an electric potential gradient having an electric potential difference of +200–+700 V is formed between the bias roller 17 (electric potential gradient generating means) and the surface of the photosensitive body 14 through the fur brush 16.

The remaining toner transferred form the photosensitive body 14 to the fur brush 16 is further transferred to the circumferential surface of the bias roller 17 due to the electric potential gradient. The blade 18 made of urethane is held by a holder 19. The edge portion of the blade 18 is brought into contact with the bias roller 17 in counterclockwise direction and scrapes off the toner from the circumferential surface of the bias roller 17. The scraped-off toner falls down onto the bottom portion of the housing of the cleaning apparatus 11. The toner accumulated in the bottom portion is withdrawn by the conveyor 200 to the withdrawing portion.

The photosensitive body 14, the bias roller 17 and the fur brush 16 all rotate clockwise. The linear velocity ratio of the rotation of the photosensitive body 14 and that of the fur brush 16 is 1:1. On the other hand, the linear velocity ratio of the rotation of the fur brush 16 and that of the bias roller 17 is 1:0.7–1:1.

Figure 2A:
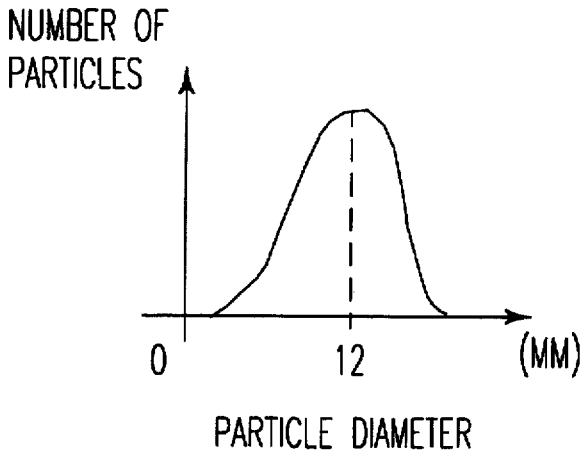
FIGS. 2(A), 2(B), 2(C), 2(D) and through 2(E) are graphs for explaining an embodiment of the present invention and its functional effect attained thereby.
Figure 2C:
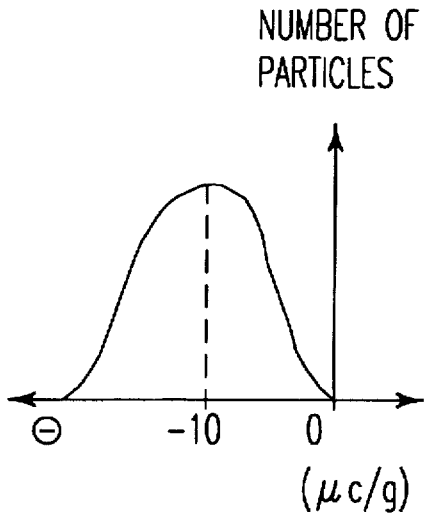

As for the toner, one produced by the "method of crushing" was prepared for evaluating its quality. The distribution of the toner's diameter was as shown in FIG. 2(A). Namely, the toner had an average diameter of almost 12 μm and there existed a distribution of the toner's diameter having an approximately symmetrical peaked shape around this diameter. The width of its distribution was in the order of 10 μm. Image forming was practiced by use of such toner as mentioned above and the distribution of charges was examined after transferring the visible image (before recharging by use of the precleaning charger). At this time, the result as shown in FIG. 2(B) was obtained. As is apparent from FIG. 2(B), in the case of employing the toner produced by the above-mentioned toner crushing method, the width of the charge distribution of the remaining toner was broad immediately after transferring the image onto the recording paper.

Using such toner, the remaining toner was recharged with negative polarity by use of the precleaning charger. As shown in FIG. 2(C), when the toner was recharged so as to make its average charge −10 μc/g, all remaining toner could be recharged with negative polarity. The peak charge amount of the charge distribution as shown in FIG. 2(C) was determined mainly by the component of the DC voltage applied to the precleaning charger 11*a*.

The AC voltage component superposed on the DC voltage component has the function of removing the electric charge on the photosensitive body and narrowing the width of the toner's electric charge distribution.

Viewing the distribution of the charge amount shown in FIG. 2(C), there further exists a large non-uniformity in the charge amount of the particles of remaining toner. For this reason, the magnitudes of the aforementioned removing bias and background soiling bias differ from each other, respectively, in accordance with the charge amount of the toner. Therefore, it is difficult to perform cleaning of all remaining toner. Namely, in order to remove the remaining toner having a large amount of charge and being strongly bound to the photosensitive body 14, it is necessary to make the aforementioned electric potential gradient large. However, if it is made too large, the electric potential difference between the bias roller 17 and the surface of the photosensitive body 14 exceeds the background soiling bias, and so an insufficient cleaning operation occurs due to the inverse charging of the remaining toner.

Next, the charge distribution of the remaining toner after recharging by the precleaning charger, and the variation of the removing bias and the background soiling bias, were examined for various toners having the same diameter distribution as that of the aforementioned toner and different relative dielectric constants. As a result, the following became apparent:

Namely, even though the relative dielectric constant of the toner varied, its charge distribution did not change much in comparison with the distribution shown in FIG. 2(C). On the other hand, the removing bias had a tendency of increasing gradually and linearly when the relative dielectric constant thereof increased, as shown by the graph line 2-1 in FIG. 2(D), and the background soiling bias decreased comparatively fast when the relative dielectric constant thereof increased as shown by the graph line 2—2.

Figure 2D:
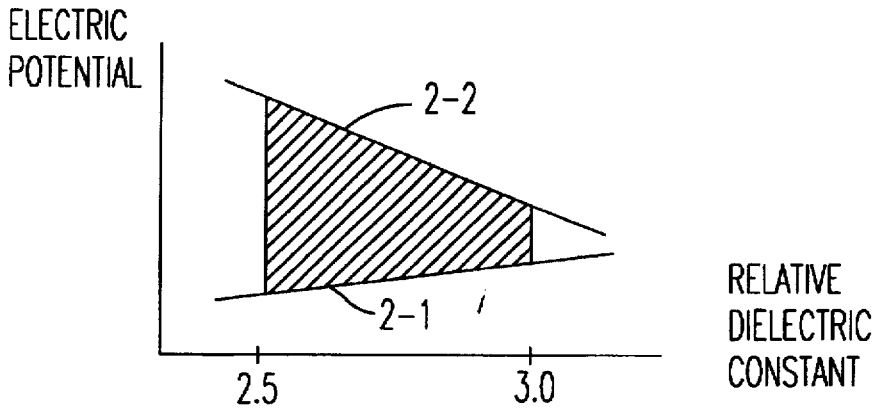

In the case where the electric potential difference corresponding to the vertical axis of FIG. 2(D) is in the range of a value larger than the removing bias and smaller than the background soiling bias, the remaining toner can be removed. It shows that, the larger the difference between both biases (namely, the removing bias and the background soiling bias), the larger becomes the tolerable limit area (margin) of the width of the charge distribution.

According to the experiment actually performed, as shown in the FIG. 2(D), when the relative dielectric constant of the toner was within the range of 2.5–3, a preferable effect on cleaning could be obtained. In particular, when the relative dielectric constant was within the range of 2.6–2.7, a very preferable effect on cleaning can be obtained.

Figure 2E:
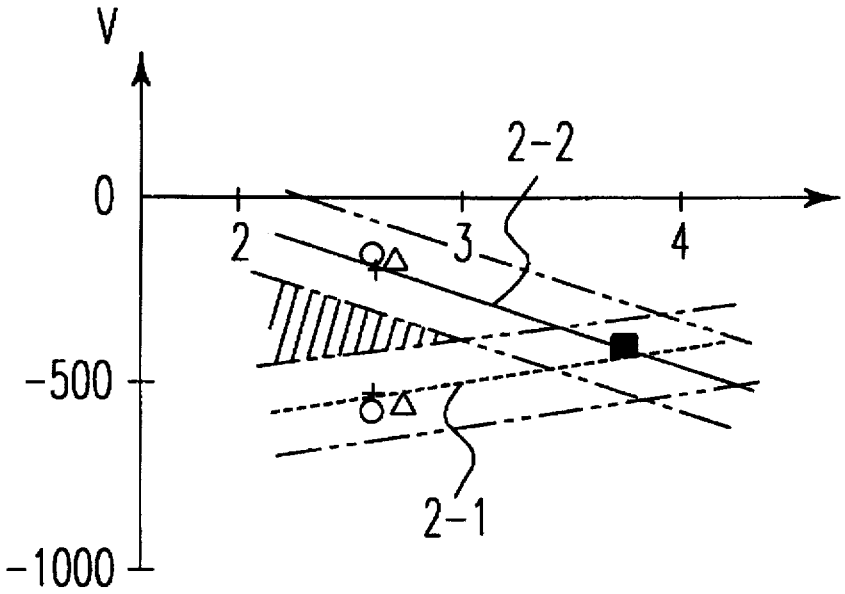
Figure 2B:
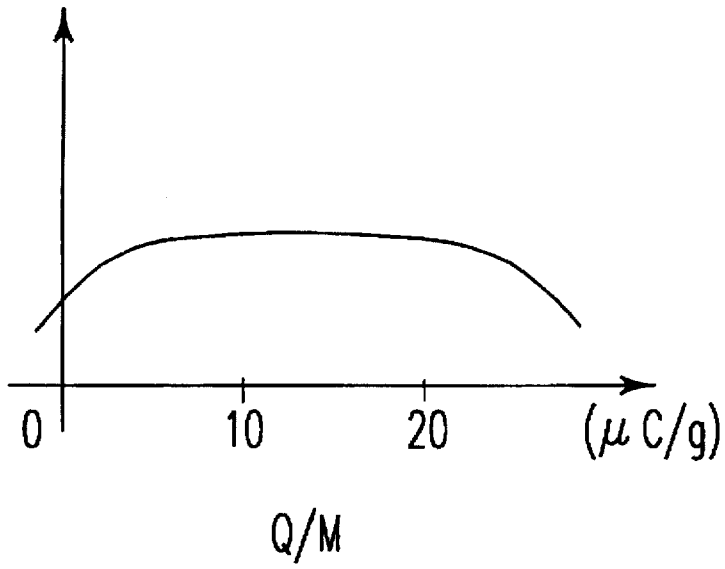

It has further been found that, in case of an actual use, there are variances both above and below the lines 21, 2—2 defined by lines as illustrated in FIG. 2(E), because the difference of the bias voltage between the photosensitive body 14 and the fur brush 16 is affected by slight changes of the atmosphere and the voltage source, by ±100 V from the lines 2-1, 2—2, as illustrated in the figure.

Needless to mention, even though the remaining toner has a certain permissible width in the charge distribution at this time, it is necessary to recharge the remaining toner by use of the precleaning charger with a predetermined polarity (in a negative polarity in the described embodiment) in the case of performing the cleaning operation with the fur brush.

Figure 4:
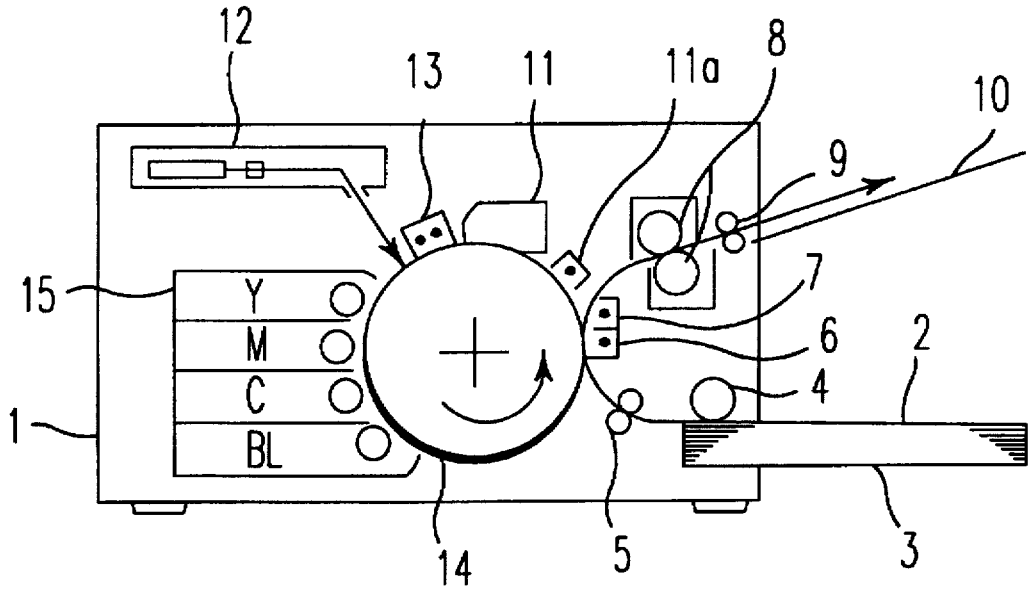
FIG. 4 shows a second embodiment having a multicolor developing apparatus.

The invention described heretofore can also be effective in the case of an apparatus for forming a color image FIG. 4. Namely, if the relative dielectric constants of the yellow, magenta, cyan and black toners are equalized in the range of 2.5–3, those remaining components of toners can be removed by use of the single (same) fur brush, all together and at the same time.

Further, in order to control the relative dielectric constant in the aforementioned range, it is effective to employ toner having coloring pigment material not containing carbon or to employ a toner made of dyestuffs. The way of manufacturing the toner is described, for example, in Japanese Laid-Open Patent No. 243267/92.

Next, the effect of cleaning with the image forming apparatus as shown in FIGS. 1(A) and 1(B) was examined in the case of employing toner produced by the above-mentioned polymerizing method.

Figure 3A:
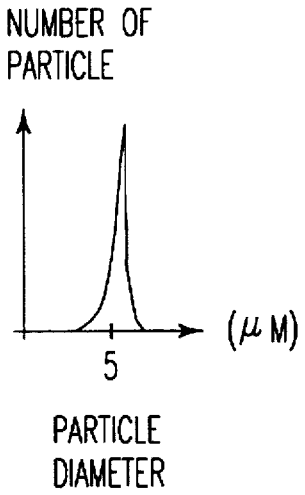
FIGS. 3(A), 3(B), 3(C) and 3(D) are graphs for explaining other embodiments of the present invention and the functional effects attained thereby.

As shown in FIG. 3(A), the diameter of the toner was within the range of 5±1 μm. It was a substantially uniform particle diameter. This toner was manufactured as shown, for example, in U.S. Pat. No. 4,885,350 or Japanese Laid-Open Patent No. 17735/78. Further, the surface of this toner was covered with wax of the weight ratio to the toner of about 1–3%. In order to further raise the fluidity of the toner, silica was annexed into the toner powder by 0.1–3% by weight.

Figure 3B:
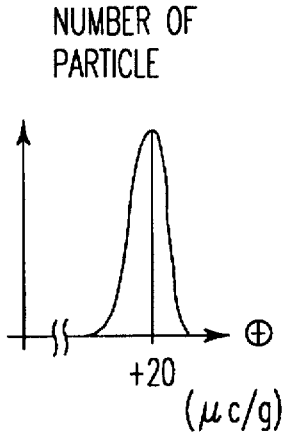

The image forming process was practiced by use of such toner as mentioned above and the charge distribution was examined after transferring the visible image (before recharging by use of the precleaning charger). At this time, the result as shown in FIG. 3(B) was obtained. As is apparent from FIG. 3(B), in the case of employing toner produced by the above-mentioned polymerizing method, the width of the charge distribution of the remaining toner was narrow even immediately after transferring the image onto the recording paper, and almost all of the remaining toner was charged in the same polarity. Consequently, if such toner is employed in the image forming apparatus, even though recharging is not performed by the precleaning charger, it is possible to perform the cleaning operation by use of the fur brush.

Figure 3C:
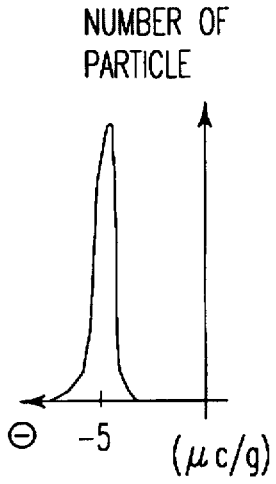

The result of further recharging the above-mentioned remaining toner by use of the precleaning charger with positive polarity shows that all of the remaining toner turns out to have a substantially uniform charge, as shown FIG. 3(C).

Consequently, it is very easy to perform cleaning of such recharged remaining toner by use of the fur brush. According to a performed experiment, it is clear that the electric potential difference for giving the electric potential gradient necessary for cleaning the remaining recharged toner (the electric potential difference between the bias roller 17 which is the electric potential generating means and the surface of the photosensitive body 14 after being recharged) has a very wide tolerable area (margin).

Figure 3D:
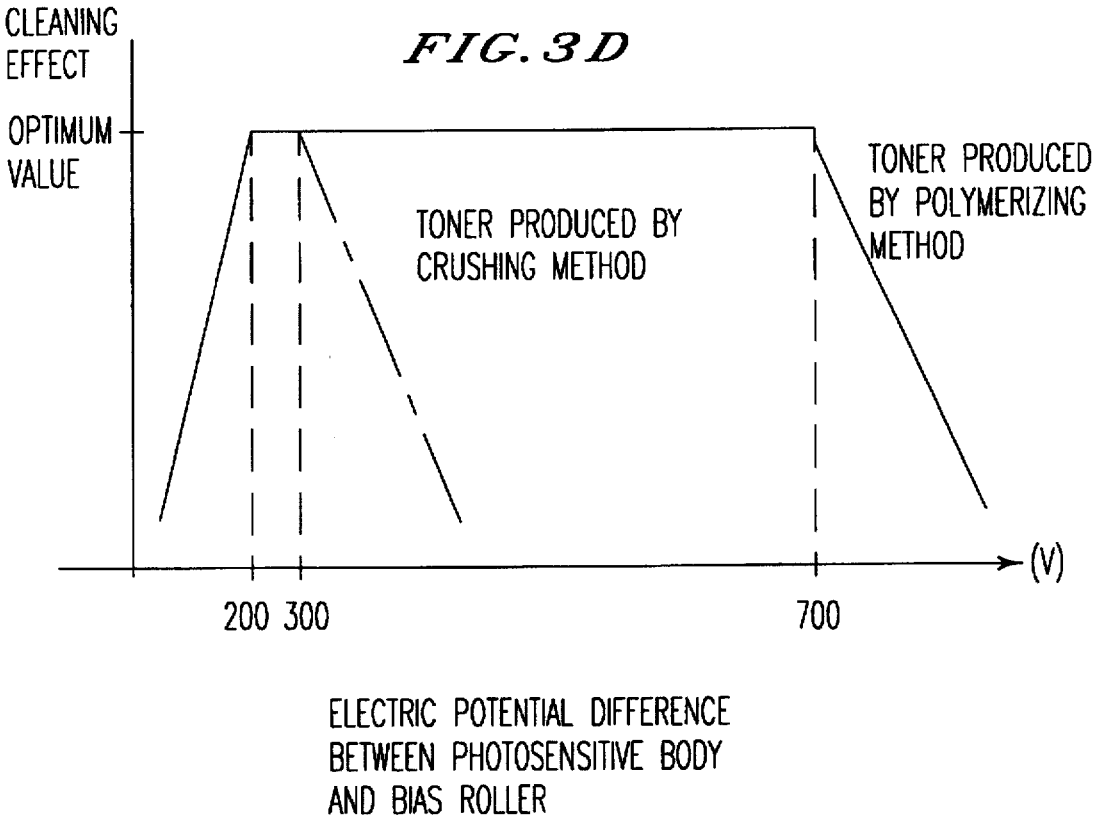

Namely, referring to FIG. 3(D), in the case of employing the toner produced by the crushing method and having a wide particle diameter distribution, the electric potential difference between the bias roller 17 and the surface of the photosensitive body 14 after being recharged is limited to the range of 200–300 V in order to obtain a preferable cleaning effect. However, in the case of employing the toner produced by the polymerizing method, when the above-mentioned electric potential difference is within the range of 200–700 V, in particular, 300–600 V, a very preferably cleaning effect could be obtained. Furthermore, this result was achieved regardless of the particle diameter of the toner formed by the polymerizing method and having uniform diameter.

In the embodiment as described heretofore, the fur brush 16 is floated electrically; that is, it is not electrically biased. However, a core roller of the fur brush 16 may also be employed as the electric potential gradient generating means in addition to the bias roller 17, and the voltage is forcibly applied to the core roller of the fur brush 16. Further, both the bias roller 17 and the core roller thereof generate the electric potential gradient so as to transfer the remaining toner to the bias roller 17 from the photosensitive body through the fur brush 16.

It may be also permissible that, in the case of applying the voltage to the core roller of the fur brush, the bias roller 17 is omitted and instead the toner in the fur brush 16 is removed therefrom by use of other means such as an intercepting plate. And further, it may also be permissible that the bias voltage source can be omitted, and, instead, different materials of electric character are applied to each of the fur brush and the intercepting plate so that they create a bias voltage with respect to the photosensitive body due to friction therebetween. An example of this is described in the Japanese Laid-Open Patent No. 7986/84.

AS is apparent from the foregoing description, it turns out to be possible to provide a novel electronic image forming apparatus according to the apparatus. Since the apparatus is constructed as mentioned heretofore, it may be possible that the toner remaining on the surface of the photosensitive body in an electrostatic image forming process is effectively cleaned and thereby preferable electrostatic image forming can be always realized.

Obviously, numerous modifications and variations of the present invention are possible in light of the above teachings. It is therefore to be understood that, within the scope of the appended claims, the invention may be practiced otherwise than as specifically described herein.

What is claimed is:

1. In an electrostatic image forming apparatus in which a photosensitive body having a photoconductive characteristic is charged uniformly, a portion on a surface of said photosensitive body is exposed to light in order to form an electrostatic latent image, the electrostatic latent image is developed by a dry-type developer employing a toner charged with a polarity, and the developed image is transferred onto a transfer paper, said electrostatic image forming apparatus comprising:

a precleaning charger applied with a discharging voltage created by superposing an AC voltage on a DC voltage of a predetermined polarity and positioned so as to recharge almost all of the toner remaining on the surface of said photosensitive body with the predetermined polarity, after transferring the developed image onto the transfer paper;

removing means for removing said remaining toner recharged by said precleaning charger from the surface of said photosensitive body; and electric potential gradient generating means for generating an electric potential gradient through said removing means for transferring the recharged toner to said removing means from said photosensitive body without inverse charging of the toner, wherein a relative dielectric constant of said toner is within a range of 2.5–3, and wherein an electrical potential difference between said electrical potential gradient generating means and the surface of said photosensitive body is within a range of about 200 V–300 V.

2. The apparatus as defined in claim 1, wherein the toner is made of one from the group consisting of coloring pigment material containing substantially no carbon, one containing dyestuffs, and one produced by polymerizing.

3. The apparatus as defined in claim 1 or 2, wherein said removing means comprises a non-electrically-insulative fur brush.

4. The apparatus as defined in claim 1, wherein a particle diameter of said toner is larger than 4 μm and not larger than 6 μm.

5. The apparatus as defined in claim 1 wherein the toner is produced by a crushing method.

6. In an electrostatic color image forming apparatus in which a photosensitive body having a photoconductive characteristic is charge uniformly, a portion on a surface of said photosensitive body is exposed to light rays to form electrostatic latent images for each resolution color, said electrostatic latent images are developed by a dry-type developer method employing resolution color toners charged with a polarity, and the developed images are transferred onto a transfer paper, said electrostatic color image forming apparatus comprising:

a precleaning charger applied with a discharging voltage created by superposing an AC voltage on a DC voltage of a predetermined polarity and positioned so as to recharge almost all of the toner remaining on the surface of said photosensitive body with the predetermined polarity after transferring each of the developed images onto the transfer paper;

removing means for simultaneously removing all of said remaining color toner recharged by said precleaning charger from the surface of said photosensitive body; and electrical potential gradient generating means for generating an electric potential gradient through said removing means for transferring the recharged toner to said removing means from said photosensitive body without inverse charging of the toner, wherein a relative dielectric constant of said color toner is within a range of 2.5–3, and wherein the toner is produced by a crushing method and an electrical potential difference between said electrical potential gradient generating means and the surface of said photosensitive body is within a range of about 200 V–300 V.

* * * * *